United States Patent [19]

Lessor et al.

[11] Patent Number: 4,890,667

[45] Date of Patent: Jan. 2, 1990

[54] METHOD AND APPARATUS FOR IMPROVING HEAT TRANSFER IN A FLUIDIZED BED

[75] Inventors: Delbert L. Lessor; Robert J. Robertus, both of Richland, Wash.

[73] Assignee: Battelle Memorial Institute, Richland, Wash.

[21] Appl. No.: 259,240

[22] Filed: Oct. 17, 1988

[51] Int. Cl.[4] ..... F28D 13/00; F28F 13/14

[52] U.S. Cl. ..... 165/1; 165/96; 165/104.16; 165/32

[58] Field of Search ..... 165/104.16, 96, 32, 165/1

[56] References Cited

FOREIGN PATENT DOCUMENTS 705242 1/1980 U.S.S.R. ..... 165/104.16
1083067 3/1984 U.S.S.R. ..... 165/104.16

OTHER PUBLICATIONS

Elsdon et al., "Heat Transfer In a Gas Fluidized Bed Assisted By an Alternating Electric Field," *Chemical Engineering Science,* 32:1147–1153 (1977).

Min et al., "Particle Transport and Heat Transfer in Gas-Solid Suspension Flow Under the Influence of an Electric Field," *Nucl. Sci. & Eng.,* 26:534–546 (1966).

Pearse et al., "The Separation of Quartz-Dolomite Powders Using a Tribo-Electric Technique," *Powder Technology,* 14:7–15 (1976).

Pearse et al., "The Triboelectric Separation of Quartz--Calcite and Quartz-Apatite Powders After Chemical Conditioning," *Powder Technol.,* 17:83–89 (1977).

Wolny et al., "Electric Charge Neutralization by Addition of Fines to a Fluidized Bed Composed of Coarse Dielectric Particles," *Journal of Electrostatics,* 14:279–289 (1983).

*Primary Examiner*—Albert W. Davis, Jr.
*Attorney, Agent, or Firm*—Klarquist, Sparkman, Campbell, Leigh & Whinston

[57] ABSTRACT

An apparatus contains a fluidized bed that includes particles of different triboelectrical types, each particle type acquiring an opposite polarity upon contact. The contact may occur between particles of the two types or between particles of etiher type and structure or fluid present in the apparatus. A fluidizing gas flow is passed through the particles to produce the fluidized bed. Immersed within the bed are electrodes. An alternating EMF source connected to the electrodes applies an alternating electric field across the fluidized bed to cause particles of the first type to move relative to particles of the second type and relative to the gas flow. In a heat exchanger incorporating the apparatus, the electrodes are conduits conveying a fluid to be heated. The two particle types alternately contact each conduit to transfer heat from a hot gas flow to the second fluid within the conduit.

21 Claims, 2 Drawing Sheets

METHOD AND APPARATUS FOR IMPROVING HEAT TRANSFER IN A FLUIDIZED BED

BACKGROUND OF THE INVENTION

This invention generally relates to method and apparatus for transferring heat in a fluidized bed and, more particularly, to a contact-charging fluidized bed heat exchanger.

It is known in the prior art that the transfer of heat from a heat source to particles in a fluidized bed is enhanced by application of an alternating electric field across the bed. As described by R. Elsdon and C. J. Shearer in "Heat Transfer in a Gas Fluidized Bed Assisted by an Alternating Electric Field," *Chemical Engineering Science,* Vol. 32, pp. 1147–1153 (1977), the alternating electric field causes back and forth movement of particles charged naturally by contact electrification in the fluidized bed. In the described apparatus, the bed of particles is rendered fluid by passing an air flow through the bed at a sufficient velocity to cause fluid motion of the particles. A heating element within the bed is grounded, and immersed electrodes alternate in polarity relative to the heating element to cause the particles to move alternately toward the electrodes and toward the heating element. The particles are of a singular type. Though both charge polarities can occur, the predominant particle charge polarity will be determined by the triboelectric nature of the particle type and the materials the particles contact. It is believed that the heat transfer rate is enhanced because driving the particles in this manner causes them to traverse the boundary layer of gas that otherwise surrounds and insulates the element and to contact the heating element. It is also believed that the movement of the particles in the region of the boundary layer acts to stir the gas and erode the boundary layer. As a result of the alternating field, heat transfer rates from the heating element to the particles in the bed are increased.

One use mentioned in the above article for this technique could be for drying paper or textiles. The material to be dried would be passed through the fluidized bed containing heating elements. The material would dry faster than otherwise because of the demonstrated increase in heat transfer rate from the heating element to the particles.

Despite theoretical possibilities, this technique has achieved little commercial use to date. One likely cause is that the heat transfer improvements with a single particle type have been insufficient to justify the use of a high alternating voltage.

SUMMARY OF THE INVENTION

An object of the invention, therefore, is to provide a method and apparatus for improving the heat transfer rate in a fluidized bed.

A second object of the invention is to provide such an apparatus that improves the heat transfer rate from particles in the fluidized bed to structures in communication with the bed.

A third object of the invention is to provide such an apparatus that allows more precise control over the heat transfer rate.

A fourth object of the invention is to provide a heat exchanger that incorporates the apparatus transferring heat from the first fluid to a second fluid.

In accordance with these objects, the particles that are to receive heat are intermixed within an apparatus that includes particles of a second type. The particles of a second type are selected because of a known propensity to acquire a charge polarity opposite to the charge polarity acquired by particles of the first type. The charge polarity is acquired on contact between particles of the two types or between particles of either type and structure or fluid present in the apparatus. The apparatus further includes means for passing a fluid through the particle mixture to produce a fluidized region of particles. The particles of each type acquire their opposite charges in the fluidized state. A heat source is provided for heating the fluidized bed. The heat source can be either the fluidizing flow or a hot object within the bed. Means are also included for applying an alternating electric field across the fluidized region to move particles of the first type relative to particles of the second type and relative to the heat source. Such relative movement improves the transfer of the heat to particles of the first type.

In the present apparatus, thermostatic means may be included in communication with an EMF source of the electric field and with the particles of the first type. The thermostat may be constructed to change the amplitude or frequency of the EMF source to control the heat transfer rate.

In another embodiment of the invention, the apparatus is incorporated into a heat exchanger. The heat exchanger includes means for passing a first fluid such as a hot gas through the particles to produce the fluidized region. Heat is transferred from the gas to the particles as the particles of each type acquire opposite charges in the fluidized state. A conduit conveying a second fluid to receive the heat from the first fluid is in communication with the fluidized region. The electric field is applied to cause the particles of each type to move toward or away from the conduit. Heat is thereby transferred from the particles to the conduit and to the second fluid therein.

In one embodiment of the heat exchanger, at least two conduits are included. The source of the electric field is constructed to apply one polarity of an alternating electrical potential to one conduit and the other polarity of the alternating electrical potential to the other conduit. As the field alternates, the charged particles are alternately pushed toward or away from each conduit.

In a second embodiment of the heat exchanger, a rod-type electrode replaces the second conduit in communication with the fluidized region. The source of the electric field applies one polarity of the potential to the conduit and the other polarity to the rod electrode. The use of the rod instead of the conduits as the second polarity electrode prevents a possible short circuit from developing across the second fluid.

The foregoing and other objects, features, and advantages of the invention will become more apparent from the following detailed description of several embodiments which proceeds with reference to the accompanying drawings. cl BRIEF DESCRIPTION OF THE DRAWINGS FIG. 1 is a block diagram of an apparatus according to the invention.

DETAILED DESCRIPTION

Figure 1:
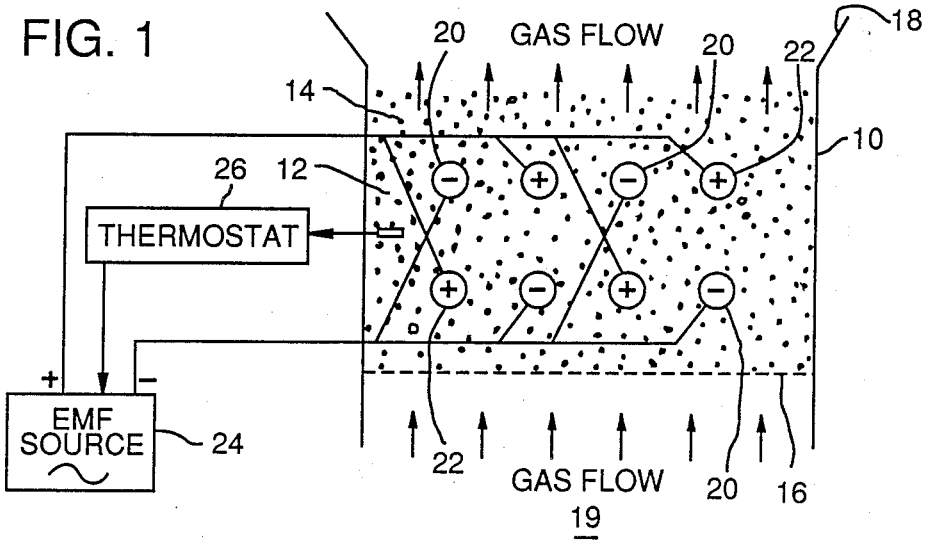

Referring now to drawings, FIG. 1 shows a block diagram of an apparatus according to the invention. Container 10 is provided for housing a mixture of particles of first and second triboelectrical types, each type acquiring an opposite electrical charge on contact. The charge polarity is acquired on contact between particles of the two types or between particles of either type and structure or fluid present in the apparatus. Placed within the container 10 are particles 12 of the second type which are known before hand to acquire in this environment charge opposite the charge of particles 14 of the first type. Particles 14 are the particles it is desired to dry or cure. For example, assume particles 14 acquire a negative electrical charge in this environment. Particles that acquire a positive charge on contact with them are then chosen for the second particles.

Means such as a porous bottom 16 and an aperture top 18 are provided within the apparatus for passing a fluid through the mixture of the two particle types to produce a fluidized region or bed. The fluid such as gas flow 19 enters the container 10 through bottom 16, passes through the particle mixture, and exits through top 18. The gas flow is of sufficient velocity to agitate the particles 12 and 14 to cause each particle type to acquire opposite charges in the fluidized state. The gas flow may also serve as a heat source for heating the fluidized region and thereby transfer heat to the particles 14.

Also provided within the apparatus is means for applying an alternating electric filled across the fluidized region. Such means include in FIG. 1 a plurality of electrodes 20 and 22 interspersed within the fluidized bed in an array. Electrodes 20 and 22 are connected to an EMF source 24, here shown with instantaneous negative polarity of the source connected to electrodes 20 and the instantaneous positive polarity of the source connected to electrodes 22. By connecting the electrodes 20, 22 to EMF source 24 in this manner, the particles 12 and 14 are alternately drawn to each electrode on each half cycle. The alternating electric field thus moves particles 14 relative to particles 12 and to gas flow 19.

The alternating field enhances heat transfer through a number of mechanisms. First, thermal contact between gas flow 19 and particles 14 is improved by imparting translation and some rotational motion to the particles. Gas mixing is also improved. Second, if the electrodes are heating elements or conduits to be heated, the particle motion to and from the electrodes 20, 22 carries heat from the hotter to the colder region, penetrating whatever boundary layer may be present. Third, thermal contact between the particles and the electrodes is improved by forcefully squeezing out the gas layer surrounding the electrodes and by increasing the duration of contact. Fourth, the alternating field enhances radial motion of the particles to and from each electrode surface. This motion erodes the boundary layer by transporting azimuthal or axial momentum into the layer from the bulk fluid and by stirring the fluid in the boundary layer.

The novel use of two triboelectrically dissimilar particle types has distinct advantages over the prior singular particle technique:

1. More intense charging is obtained. Particles of a single type only acquire significant charge upon contact with nonparticle structure or with flowing fluid. Particles in the center of a gas flow thus may not charge as intensely and may not respond as desired to the alternating electric field to move toward or away from electrodes. Dissimilar colliding particles, on the other hand, achieve significant charging anywhere in the flow region.

2. Heat transfer is enhanced. Particles are attracted to electrodes during each half cycle of the applied electrical potential, rather than only once a cycle.

3. Particle mixing and fluid mixing is enhanced. The relative motion of the two particle types tends to prevent agglomeration and to improve thermal contact between particles and fluid.

4. Bulk deflection does not occur. With roughly equal portions o both particle types, the effect of deflection in one direction is largely cancelled by deflection in the opposite direction.

Regulating the drying temperature within container 10 is effected by means such as a thermostat 26 shown in communication with the EMF source 24 and with the fluidized region in container 10. The thermostat 26 may be set to maintain the desired temperature for drying or curing the particles 14. In the present embodiment, thermostat 26 is constructed to change the amplitude or frequency of the electrical potential generated by EMF source 24. Changing the amplitude changes the strength of the applied electric field, while changing the frequency affects the rate in which the particles contact the heating electrodes 20, 22. At DC, the particles 12, 14 will actually coat the electrodes and insulate them from the bulk of the particles within the fluidized bed. By so insulating the heating elements, the heat transfer rate can be decreased more than by simply turning off the heating elements.

Figure 2:
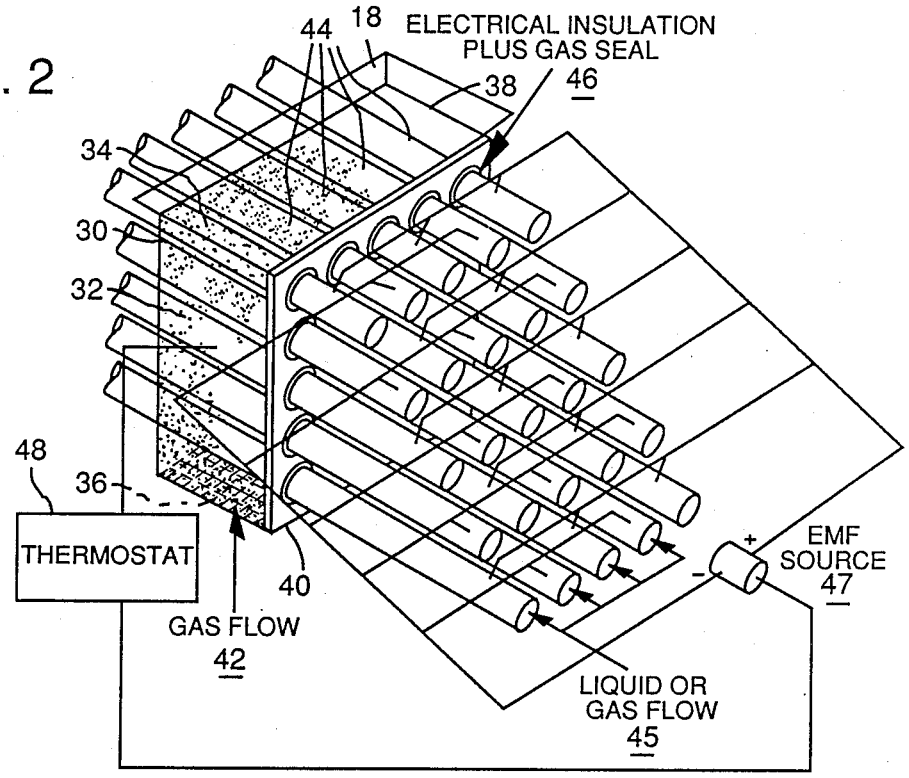
FIG. 2 is a perspective view of a heat exchanger that incorporates the apparatus of the invention.

The apparatus herein described may be incorporated into a heat exchanger by transferring the heat acquired by the particles within the fluidized bed to a second fluid. FIG. 2 illustrates such a heat exchanger. A container 30 is provided for housing particles of first and second types 32 and 34. Such particle types, for example, may be quartz and dolomite which acquire negative and positive charges, respectively, upon contact with each other. The container 30 includes a porous bottom 36, sidewalls (shown transparent for illustration), a aperature top 8, and a flow-coating tube sheet 40 on the front and rear walls. With this construction, container 30 acts as a means for passing a first fluid such as a flow 42 of hot gas through the particles to produce a fluidized particle bed. In this process, heat is transferred from the gas to the particles, and each of the particle types 32, 34 acquires opposite charges in the fluidized state.

A number of considerations guide the choice of an appropriate size and types for particles 32 and 34, including the following:

1. The charge-to-mass ratio (q/m) must be sufficiently large that the particle motion may be readily altered by the applied, alternating electric field.

2. The particles must not be so small that molecular forces (i.e., Van der Waals Force) cause them to permanently adhere to the exterior of tubes 44 that extend through the fluidized bed. Either a reversed field sign or new particle impacts should eject the particles.

3. The particle size must permit fluidized velocities in a practical range.

With these considerations, research has led to a determination that particles in the 100 micron range and composed of quartz and dolomite may be preferable.

Another choice of a particle material pair may be a polymer such as TEFLON and glass.

Extending through the container 30 between the tube sheets 40 is an array of tubes or conduits 44 that communicate with the fluidized bed. The tubes 44 convey a second fluid or gas flow 45 to receive heat from the gas flow 42. Each tube 44 is electrically insulated from the tube sheet 40 by a seal 46. Each seal 46 also acts to seal its tube to the tube sheet to prevent gas from escaping from the container interior.

As in the previously described apparatus, means are provided for applying an electric field across the fluidized bed to alternately drive particles toward or away from the conduits. Such means comprise an EMF source 47 with its instantaneous positive polarity connected to alternating tubes in the array and the negative polarity connected to the remainder of the tubes. The EMF source 47 thus alternately drives charged particles of each type toward or away from each tube in each half cycle.

For regulating the temperature of the second fluid, thermostat 48 is provided in communication with the EMF source 47 and the second fluid within the conduit. The thermostat 48 regulates the heat transfer rate to the second fluid by varying the frequency and amplitude of the electric field generated by the source 47, as previously described.

Figure 3:
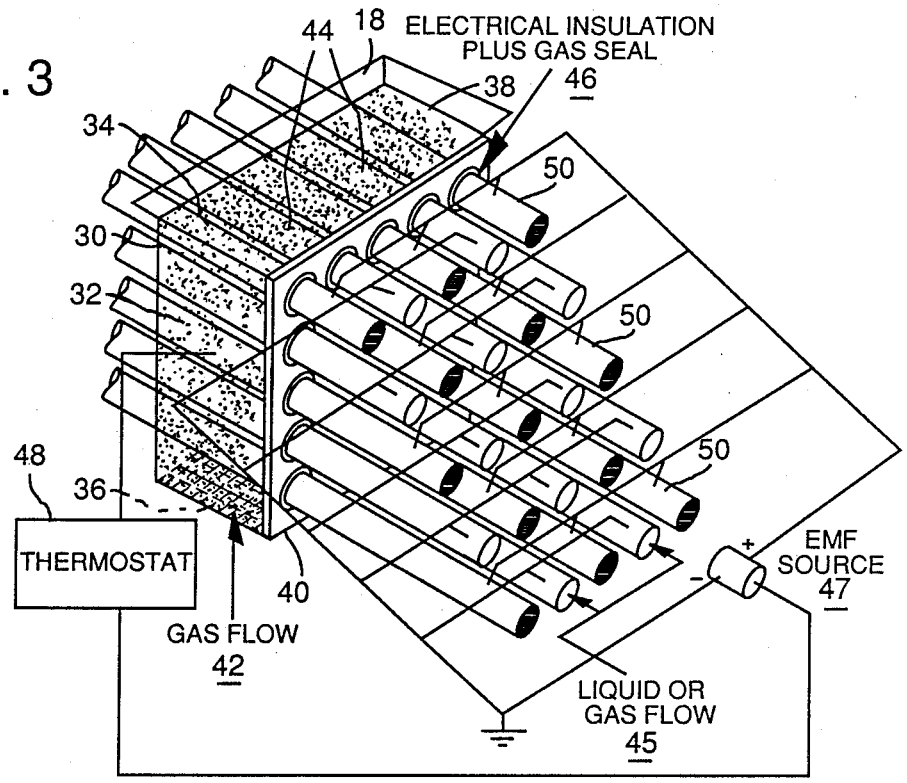
FIG. 3 is a perspective view of a second embodiment of a heat exchanger.

It is possible in some applications that the heat exchanger of FIG. 2 may be short circuited because of the electrical conductivity of the second fluid 45. This fluid is drawn from a common source and flows to a common destination. To prevent this possible short from occurring, FIG. 3 illustrates a second heat exchanger in which alternate tubes in the array are replaced with electrodes such as solid rods 50. The rods 50 are electrically insulated from the conduits 44 and do not come into contact with the second fluid, thus preventing a short circuit via the second fluid. The tubes 44 in this embodiment may all be electrically connected together with the tube sheet 40 and set at ground potential. In all other respects, the heat exchanger of FIG. 3 is identical in design and operation to the exchanger of FIG. 2.

Having illustrated and described the principles of the invention in several embodiments, it should be apparent to those skilled in the art that the invention can be modified in arrangement and detail without departing from such principles. We claim all modifications coming within the spirit and scope of the following claims.

We claim:

1. Apparatus for improving the transfer of heat from a heat source to particles of a first type, comprising:

particles of a second type known to acquire a charge polarity upon contact opposite to the charge polarity acquired by particles of a first type upon contact, said contact occurring between particles of the two types or between particles of either type and structure or fluid present in the apparatus;

means for passing a fluid through a mixture of the two particle types to produce a fluidized region of particles, said particles of each type acquiring opposite charges in the fluidized state; and means for applying an alternating electric field across the fluidized region to move particles of the first type relative to particles of the second type and relative to the fluid to improve the transfer of heat to particles of the first type.

2. The apparatus of claim 1 including a heat source for heating the fluidized region.

3. The apparatus of claim 2 wherein the heat source comprises heating elements interspersed within the fluidized region to transfer heat to the particles of the first type as said particles move into contact with the elements.

4. The apparatus of claim 1 wherein the field applying means comprises at least two electrodes interspersed within the fluidized region with one polarity of an electrical potential applied to one electrode and the other polarity of the electrical potential applied to the other electrode.

5. The apparatus of claim 1 including thermostatic means in communication with the field applying means and the particles of the first type for regulating the temperature of said particles, the thermostatic means being constructed to change the amplitude or frequency of an electrical potential generating the field to control the heat transfer rate from the heat source to said particles.

6. The apparatus of claim 1 wherein the particles of the first type are granular polymers.

7. The apparatus of claim 1 wherein the particles of the second type are glass.

8. The apparatus of claim 1 wherein the particles of the second type are quartz.

9. A heat exchanger comprising:

particles of two types, one type acquiring a positive charge on contact and the other type acquiring a negative charge on contact, said contact occurring between particles of the two types or between particles of either type and structure or fluid present in the apparatus;

means for passing a first fluid through a mixture of the two particle types to produce a fluidized region of said particles to transfer heat from the fluid to the particles as the particles of each type acquire opposite charges in the fluidized state;

a conduit in communication with the fluidized region for conveying a second fluid to receive the heat from the first fluid; and means for applying an electric field across the fluidized region to move the charged particles toward and away from the conduit exterior to transfer heat from the particles to the conduit and thereby to the second fluid therein.

10. The heat exchanger of claim 9 wherein the field applying means is constructed to bring the charged particles of each type into contact with the conduit exterior.

11. The heat exchanger of claim 9 wherein the field applying means is constructed to apply an alternating electric field.

12. The heat exchanger of claim 9 including at least two conduits and wherein the field applying means is constructed to apply one polarity of an alternating electrical potential to one conduit and the other polarity of the alternating electrical potential to the other conduit to alternately bring charged particles of each type into contact with each conduit.

13. The heat exchanger of claim 9 wherein the first particle type is quartz and the second particle type is dolomite.

14. The heat exchanger of claim 9 including a solid electrode in communication with the fluidized region and wherein the field applying means is constructed to apply one polarity of an alternating electrical potential to the conduit and the other polarity of the alternating electrical potential to the electrode to alternately bring charged particles of each type into contact with the conduit.

15. The heat exchanger of claim 9 wherein the particles are each sized so as to have a sufficient charge to mass ratio to permit alteration of their motion by an applied electric field and yet be able to resist molecular forces that otherwise would cause the particles to adhere to the conduit exterior.

16. The heat exchanger of claim 9 wherein the particles are each approximately 100 microns in diameter so as to be small enough to have a sufficient charge to mass ratio to permit alteration of their motion by an applied electric field and yet to be large enough to resist molecular forces that otherwise would cause the particles to adhere to the conduit exterior.

17. The heat exchanger of claim 9 including thermostatic means in communication with the field applying means and the second fluid for regulating the temperature of the second fluid, the thermostatic means being constructed to change the amplitude or frequency of an electrical potential generating the field to control the heat transfer rate from the particles to the conduit.

18. A heat exchanger comprising:

particles of differing types, one type acquiring a positive charge on contact and another type acquiring a negative charge on contact, said contact occurring between particles of the two types or between particles of either type and structure or fluid present in the apparatus;

means for passing a first fluid through a mixture of the two particle types to produce a fluidized region of said particles to transfer heat from the fluid to the particles as the particles of each type acquire opposite charges in the fluidized state;

a conduit in communication with the fluidized region for conveying a second fluid to receive the heat from the first fluid;

an electrode in communication with the fluidized region; and means for applying an alternating electric field across the fluidized region, the means being constructed to apply one polarity of an alternating electrical potential to the conduit and the other polarity of the alternating electrical potential to the electrode to alternately bring charged particles of each type into contact with the exterior of the conduit to transfer heat from the particles to the conduit and thereby to the second fluid therein.

19. The heat exchanger of claim 18 wherein the electrode comprises a second conduit.

20. A method of improving the transfer of heat from a heat source to particles of a first type, comprising:

providing particles of a second type known to acquire a charge polarity upon contact opposite to the charged polarity acquired by particles of the first type upon contact, said contact occurring between particles of the two types or between particles of either type and structure or fluid present in the apparatus;

passing a fluid through a mixture of the two particle types to produce a fluidized region of particles, said particles of each type acquiring opposite charges in the fluidized state; and applying an alternating electric field across the fluidized region to move particles of the first type relative to particles of the second type and relative to the fluid to improve the transfer of heat to said particles of the first type.

21. A method of improving the exchange of heat from a first fluid to a second fluid, comprising:

providing particles of two types, one type acquiring a positive charge on contact and the other type acquiring a negative charge on contact, said contact occurring between particles of the two types or between particles of either type and structure or fluid present in the apparatus;

passing a first fluid through a mixture of the two particle types to produce a fluidized region of said particles to transfer heat from the fluid to the particles as the particles of each type acquire opposite charges in the fluidized state;

conveying a second fluid through a conduit in communication with the fluidized region; and applying an alternating electric field across the fluidized region to alternately drive charged particles of each type toward or away from the conduit to transfer heat from the particles to the conduit and thereby the second fluid therein.

* * * * *